US006605250B1

(12) United States Patent
Reiso et al.

(10) Patent No.: US 6,605,250 B1
(45) Date of Patent: Aug. 12, 2003

(54) ARRANGEMENT IN CONNECTING WITH COOLING EQUIPMENT FOR COOLING BILLETS

(75) Inventors: Oddvin Reiso, Sunndalsøra (NO); Ulf Tundal, Sunndalsøra (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 09/856,357

(22) PCT Filed: Nov. 19, 2000

(86) PCT No.: PCT/NO99/00350

§ 371 (c)(1),
(2), (4) Date: Jul. 11, 2001

(87) PCT Pub. No.: WO00/30780

PCT Pub. Date: Jun. 2, 2000

(30) Foreign Application Priority Data

Nov. 23, 1998 (NO) ..... 19985470

(51) Int. Cl.[7] ..... B21C 9/00
(52) U.S. Cl. ..... 266/114; 266/46
(58) Field of Search ..... 266/113, 114, 266/46; 164/89

(56) References Cited

U.S. PATENT DOCUMENTS 3,918,467 A * 11/1975 Alberny et al. ..... 164/89
4,042,227 A * 8/1977 Niehaus et al. ..... 266/114
4,136,527 A * 1/1979 Kading ..... 164/89
4,185,810 A 1/1980 Eichenberger et al.
4,462,234 A 7/1984 Fiorentino et al.
4,829,802 A 5/1989 Baumann
5,027,634 A * 7/1991 Visser et al. ..... 72/270
5,112,412 A 5/1992 Plata et al.
5,425,386 A 6/1995 Gentry et al.

OTHER PUBLICATIONS

Patent Abstracts of Japan 7–323328, by Showa Alum Corp., Dec. 12, 1995.

* cited by examiner

*Primary Examiner*—Scott Kastler
(74) *Attorney, Agent, or Firm*—Wenderoth, Lind & Ponack, L.L.P.

(57) ABSTRACT

Apparatus for cooling billets (9), preferably formed of aluminum. The apparatus includes a housing (2) provided with openings (3) for axial passage of the billet through the housing, a cooling ring (4) arranged inside of the housing, and supply lines (6) for supplying a cooling medium to the housing. The cooling medium is supplied to the billet (9) in order to achieve uniform cooling, i.e. cooling without a temperature gradient, around the entire circumference of the billet. The apparatus is capable of rotating the billet while the cooling medium is supplied uniformly around the circumference of the billet (90).

8 Claims, 2 Drawing Sheets

ARRANGEMENT IN CONNECTING WITH COOLING EQUIPMENT FOR COOLING BILLETS

BACKGROUND OF THE INVENTION

The present invention concerns an arrangement in connection with equipment for cooling billets, preferably of aluminium, comprising a housing with openings for axial passage of the billet through the housing as well as an internal cooling ring with supply lines for a cooling medium.

The maximum extrusion speed depends, among other things, on the temperature of the billet before the start of the extrusion process, as well as the, alloy and the prior temperature history of the billet. The prior temperature history for AlMgSi alloys is significant because it affects the content of MgSi phases in the billet. It is generally known that large quantities of MgSi phases present in the billet before the start of the extrusion operation will result in a poorer quality of extrudate and a lower maximum extrusion speed.

In the applicant's own European Patent No. 0302623, a method is described for the production of an aluminium alloy for extrusion purposes in which the alloy undergoes a certain heat treatment before cooling, immediately before extrusions of the alloy, to avoid the MgSi phases.

The cooling immediately before extrusion is performed using cooling equipment arranged in connection with the extrusion equipment.

U.S. Pat. No. 5,027,634 describes cooling equipment in which the aluminium billet is designed to be passed through a cooling ring with two annular nozzles for the supply of the cooling liquid along the full circumference of the billet. This solution has proved to produce uneven cooling along the circumference and thus a temperature gradient over the cross-section of the billet. In turn, this has the result that, in extrusion equipment in which several extrudates are extruded through multi-aperture extrusion tools, the extrudates are pressed out at different speeds with different qualities.

It is otherwise common to produce a temperature difference or temperature gradient in the longitudinal direction of a billet before extrusion in order to achieve consistent quality over the full length of the extrudate. The temperature gradient is created to compensate for the heat which is generated during the extrusion process. More precisely, the billet is cooled so that the temperature of the end which is closest to the extrusion tool is highest while the other end, which is furthest away from the tool, is the coolest. This cooling can be adapted so that, depending on the extrusion speed, etc., the temperature in the extrudate at the outlet of the extrusion nozzle is always the same.

For example, U.S. Pat. No. 2,639,810 describes a solution in which the billet, before extrusion in a press, is cooled so that a temperature gradient is formed between the ends of the billet. The temperature gradient can, in accordance with the patent specification, be achieved by spraying the billet or by dipping one end of the billet in water.

However, the latter prior art cooling equipment solution also entails a disadvantage for the billet, namely that the cooling along the circumference, and thus over the cross-section of the billet, is uneven and uncontrolled.

This has also been confirmed in tests in which measurements were taken at four points along the periphery of a billet immediately after cooling of the billet through a cooling ring in which cooling water was supplied evenly along the periphery through a gap. The tests showed that the temperature difference between the top and bottom of the billet could be as much as 40–50° C. and that the top was coldest and the bottom hottest.

At first sight, it seems somewhat surprising that the top is coldest as one would have expected gravitational force to have resulted in a greater collection of water against the bottom of the billet and thus increased cooling of the bottom. However, on closer observation, the effect seems to be caused by a combination of greater spread and longer cooling exposure time for the water on the top of the billet as well as boiling and thus partial formation of a vapor barrier layer against the bottom of the billet.

SUMMARY OF THE INVENTION

The present invention is directed to an arrangement in connection with the cooling of billets in which the above problems are greatly reduced or completely eliminated.

The present invention is characterized in that the billet is designed to be supplied with a cooling medium so that even cooling is achieved, and temperature gradient around the circumference of the billet is avoided.

BRIEF DESCRIPTION OF THE DRAWINGS

The present invention will be described in further detail in the following using examples and with reference to the attached drawings in which.

DETAILED DESCRIPTION OF THE INVENTION

Figure 1:
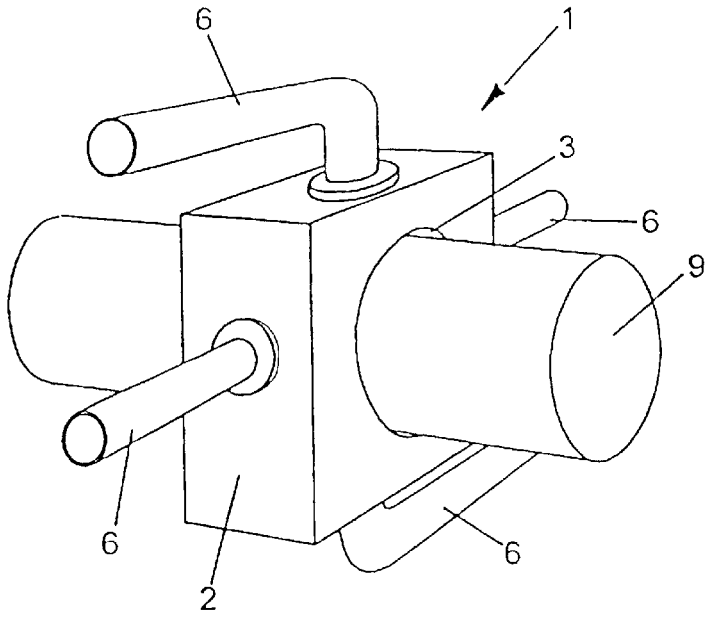
FIG. 1 is a perspective view of cooling equipment for cooling billets.
Figure 2:
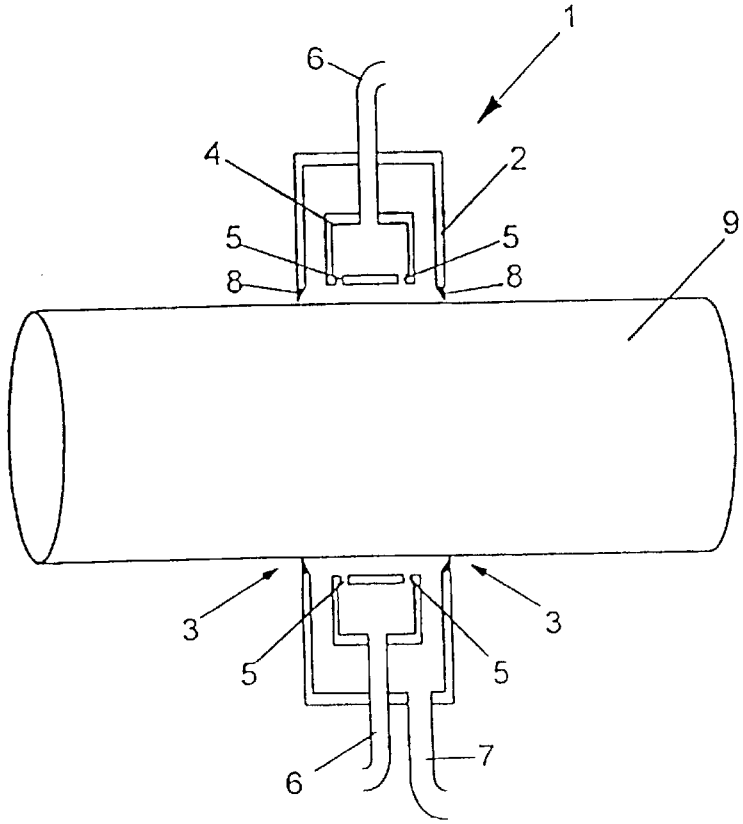
FIG. 2 is a cross-section of the cooling equipment of FIG. 1.

As shown in FIGS. 1 and 2, the cooling equipment 1 includes a housing 2 with openings 3 for passing through a billet 9 which is to be cooled, and an internal cooling ring 4 with annular nozzles 5 for the supply of a cooling medium, usually water. The water may be supplied in the form of pulses, or together with pressurised air to increase the velocity, and thereby the cooling effect.

The cooling ring is supplied with the cooling medium via supply lines 6 from a source or reservoir (not shown).

During the cooling of a billet 9, the cooling medium is sprayed against the billet through the annular nozzles 5 around the full periphery of the billet. The used cooling medium is collected in the base of the housing 2, and evacuated from the housing via the discharge line 7. The housing 2 is otherwise provided with gaskets 8 at the openings 3 to reduce or prevent water spray into the surroundings.

Figure 3:
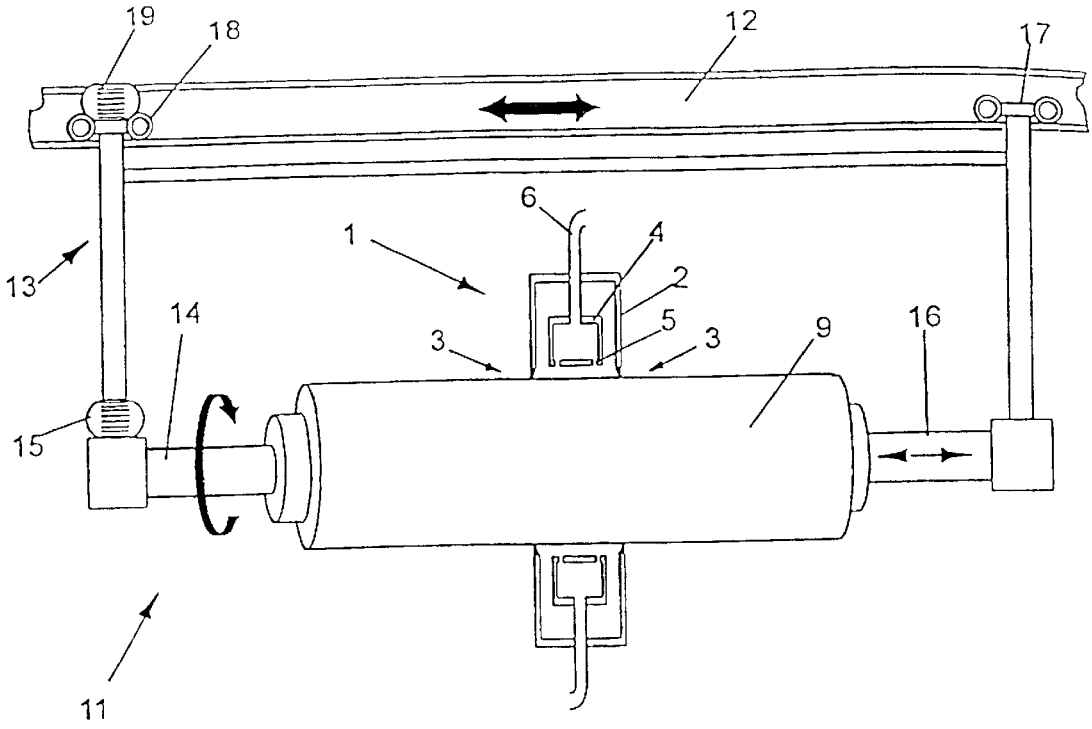
FIG. 3 is an arrangement for passing (transporting) and rotating a billet through the cooling equipment in accordance with the present invention.

FIG. 3 shows an example of an arrangement constructed in accordance with the present invention for achieving uniform cooling of a billet around its full periphery.

More precisely, FIG. 3 shows a solution in which the billet is designed to rotate in order to achieve such uniform cooling. As the figure shows, the billet 9 is held in place between a rotating clamp arrangement 11 in a crab 13 which is suspended from and can be moved along a rail 12 located above the cooling equipment 1. The clamp arrangement comprises a shaft 14 driven by a motor 15 on one side and a free-running shaft 16 on the other side. In order to fix the billet during cooling, either one shaft, preferably the free-running shaft 16, can be axially displaceable and designed to be brought into contact with the end of the billet and thus clamp the billet between the two shafts, or the crab 13 can be provided with a mechanism (not shown) which moves the shafts towards each other in order to achieve the same clamp effect against the billet.

Furthermore, the crab 13 is provided, on its side, with a pair of free-running wheels 17 and a pair of wheels 18 which are driven by a motor 19 and can be moved along the rail 12.

The solution shown in FIG. 3 functions as follows: the crab 13 is moved completely to the left or completely to the right in relation to the cooling equipment 1 so that one shaft 16 or the other shaft 14 extends through the openings 3 in the cooling equipment housing 2. A billet 9 which is to be cooled is placed between the ends of the shafts 14, 16 and fixed by clamping between the shafts. The billet is then caused to rotate while the crab 13 is displaced along the rail 12 so that the billet is passed through the cooling housing and is cooled by the cooling medium which is sprayed through the annular nozzles 5.

In this way, by rotating the billet while cooling it, uniform cooling is achieved along the full periphery of the billet. The billet can, if required, also be cooled so that a temperature gradient is achieved in the longitudinal direction of the billet, for example, by regulating the speed of the billet through the cooling equipment. When the cooling operation is over, the crab 13 with the billet 9 is moved completely to the left or right so that the cooled billet can be released and a new billet can be placed between the shafts for the implementation of a new cooling operation.

Figure 4:
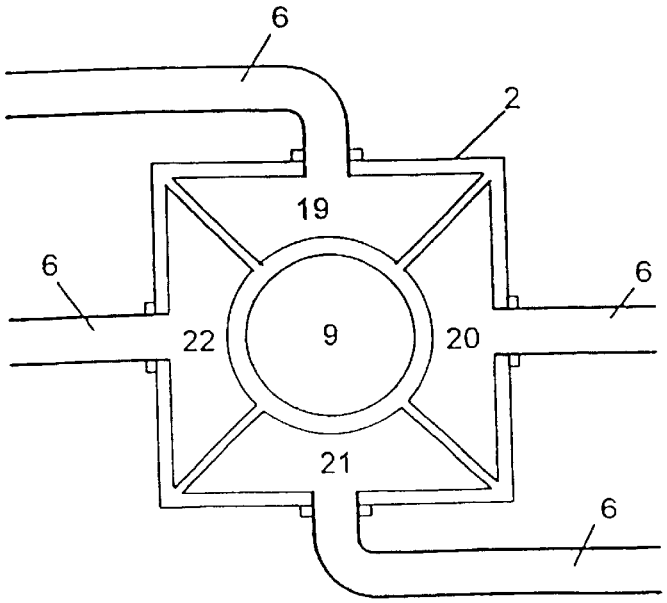
FIG. 4 is a longitudinal sectional view of an alternative cooling arrangement for the cooling equipment.

FIG. 4 shows an alternative embodiment for cooling billets in accordance with the present invention. The cooling arrangement is shown here in longitudinal section. The housing 2 and the supply lines 6 are the same as shown in the previous figures, but the cooling ring is divided into separate sections 19, 20, 21 and 22 instead of being continuous. In the example shown here, four sections are arranged, but it may be expedient to use more sections, each with an inlet for the cooling medium. The purpose of such a division into sections is that the cooling medium can be supplied in different quantities to each section in order to achieve uniform cooling around the full periphery of the billet 9. As stated by way of introduction, it has been found that, if an equal supply of cooling medium is used around the full pheriphery, the cooling is greatest on the top of the billet. With this sectional solution, the quantity of cooling medium can be varied so that more cooling can be supplied to the bottom of the billet in order to compensate for the excessive cooling on the top of the billet, making the cooling uniform around the circumference of the billet.

A third method of achieving uniform cooling around the circumference of a billet, which is not shown, will be to arrange the cooling equipment vertically so that the billet is moved in a vertical direction through the cooling equipment. In this method, the cooling medium will run down over the billet with uniform distribution in the longitudinal direction of the billet on account of gravitational force and thus prevent - non-uniform cooling.

The present invention, is not limited to the examples described above and shown in the figures. Therefore, for example, the cooling ring 4 can have fewer or more than two annular nozzles. Moreover, instead of annular nozzles it is possible to use a large number of holes or other nozzles placed around the circumference of the annular cooling arrangement 4.

In order to achieve varied cooling around the circumference of the billet, these holes or nozzles can be arranged in different numbers or sizes on the top and bottom, or it is possible to use annular gaps with different widths on the top and bottom of the billet. Furthermore, the present invention is not limited to the cooling housing 2 with cooling ring 4 being stationary as in the above examples. Thus, the cooling housing with cooling ring can be designed to move axially along the billet during the cooling operation while the billet is stationary.

One alternative, which is not shown in the drawings, is to supply the water through a longitudinal slit, letting the billet at the same time be subjected to rotation. To provide the billet with a temperature gradient in the longitudinal direction, the water may be unevenly distributed along the slit.

What is claimed is:

1. An apparatus for cooling a billet prior to an extruding operation, said apparatus comprising:

a housing having openings to permit axial passage of the billet through the housing;

at least one cooling ring, disposed in said housing, for directing a cooling medium in a direction that is perpendicular to a longitudinal axis of the billet;

a plurality of supply lines for supplying the cooling medium to said cooling ring, wherein the cooling ring is adapted to supply the cooling medium around the entire circumference of the billet to achieve uniform cooling of the billet; and a device for rotating the billet as the cooling medium is supplied to the billet.

2. An apparatus for cooling a billet prior to an extruding operation, said apparatus comprising:

a housing having openings to permit axial passage of the billet through the housing;

at least one cooling ring, disposed in said housing, for directing a cooling medium in a direction that is perpendicular to a longitudinal axis of the billet;

a plurality of supply lines for supplying the cooling medium to said cooling ring, wherein the cooling ring is adapted to supply the cooling medium around the entire circumference of the billet to achieve uniform cooling of the billet; and a device for clamping and rotating the billet as the cooling medium is supplied to the billet.

3. The apparatus as claimed in claim 2, wherein the device for clamping and rotating the billet comprises:

a rail positioned above said housing; and a crab suspended from and movable along said rail, said crab including a pair of rotatable shafts for clamping the billet therebetween, wherein the crab can be moved along the rail to move the billet axially through the cooling ring while the billet is rotated by said rotatable shafts.

4. An apparatus for cooling a billet prior to an extruding operation, said apparatus comprising:

a housing having openings to permit axial passage of the billet through the housing;

at least one cooling ring, disposed in said housing, for directing a cooling medium in a direction that is perpendicular to a longitudinal axis of the billet; and a plurality of supply lines for supplying the cooling medium to said cooling ring, wherein the cooling ring is adapted to supply the cooling medium around the entire circumference of the billet to achieve uniform cooling of the billet, wherein said cooling ring comprises a plurality of separate sections, and each of said sections is associated with one of said supply lines such that the quantity of cooling medium supplied to each of said separate sections can be varied independently of the other of said sections.

5. The apparatus as claimed in claim 1, wherein said cooling ring is adapted to vary the quantity of cooling medium supplied around the circumference of the billet.

6. The apparatus as claimed in claim 1, wherein said cooling ring is oriented so that the billet can be passed through the cooling ring while the billet is in a vertical orientation.

7. The apparatus as claimed in claim 1, wherein said housing includes gaskets provided on circumferential housing edges.

8. The apparatus as claimed in claim 1, wherein said cooling ring includes annular nozzles adapted to spray the cooling medium around the entire circumference of the billet.

* * * * *